US009714509B2

(12) United States Patent
Morgan et al.

(10) Patent No.: US 9,714,509 B2
(45) Date of Patent: Jul. 25, 2017

(54) STRUCTURAL GLASS ASSEMBLIES

(71) Applicant: Pilkington Group Limited, Merseyside (GB)

(72) Inventors: Timothy John Morgan, Manchester (GB); Philip Glyn Thomas, Lancashire (GB); John Hilton, Chesire (GB)

(73) Assignee: Pilkington Group Limited, St. Helens, Merseyside (GB)

( * ) Notice: Subject to any disclaimer, the term of this patent is extended or adjusted under 35 U.S.C. 154(b) by 0 days.

(21) Appl. No.: 14/327,366

(22) Filed: Jul. 9, 2014

(65) Prior Publication Data

US 2014/0318058 A1 Oct. 30, 2014

Related U.S. Application Data

(62) Division of application No. 13/138,434, filed as application No. PCT/GB2010/050260 on Feb. 17, 2010, now Pat. No. 8,806,818.

(30) Foreign Application Priority Data

Feb. 17, 2009 (GB) ..... 0902627.9

(51) Int. Cl.

| | |
|---|---|
| ***E04B 1/98*** | (2006.01) |
| ***E06B 3/54*** | (2006.01) |
| ***E04B 2/96*** | (2006.01) |
| ***E04B 2/90*** | (2006.01) |

(52) U.S. Cl.

CPC ..... *E04B 1/98* (2013.01); *E04B 2/90* (2013.01); *E04B 2/96* (2013.01); *E06B 3/5436* (2013.01); *E06B 3/5445* (2013.01)

(58) Field of Classification Search

CPC ..... E04B 1/98; E04B 2/90; E04B 2/96; E04B 2/967; E04B 2/98; E06B 3/5436; E06B 3/5445; E06B 3/5892; E04F 13/0855; E04F 13/081; E04F 13/0814

USPC ..... 52/234, 235, 204.62, 204.63, 204.64, 52/204.67, 204.69, 144, 145, 167.7, 52/167.8, 167.9

See application file for complete search history.

(56) References Cited

U.S. PATENT DOCUMENTS 3,052,330 A * 9/1962 Hammitt ..... E04B 2/96 52/235
3,140,565 A * 7/1964 Ward, Jr. ..... E04B 2/92 52/209
3,223,209 A * 12/1965 Skromeda ..... 403/263

(Continued)

*Primary Examiner* — James Ference
(74) *Attorney, Agent, or Firm* — Marshall & Melhorn, LLC

(57) ABSTRACT

A glazing system for a building comprising a glazing panel, a support and an attachment assembly for attaching the glazing panel to the support is disclosed. The attachment assembly comprises a mounting secured to the support and a glazing fitting secured to the glazing panel. The mounting comprises a mounting member and the glazing fitting comprises a hook portion and the mounting is connected to the glazing fitting by a connection between the hook portion and the mounting member. The attachment assembly further comprises a shock absorber that allows the attachment assembly to move relative to the support upon applying an impact to the glazing panel, thereby improving the impact resistance of the glazing panel. Mountings and fittings for use in such glazing systems are also disclosed, as are methods of improving the impact resistance of a suspended glazing panel.

13 Claims, 16 Drawing Sheets

(56) References Cited

U.S. PATENT DOCUMENTS 3,321,880 A * 5/1967 Ferrell et al. ..... 52/235
3,367,077 A * 2/1968 Johnston ..... 52/464
3,509,674 A * 5/1970 Birum, Jr. ..... 52/302.1
4,448,001 A * 5/1984 Whitmyer et al. ..... 52/209
4,561,228 A * 12/1985 Kaminaga ..... E04B 2/96 52/204.591
4,582,446 A * 4/1986 Salice ..... F16B 12/2027 403/215
4,608,793 A * 9/1986 Yost et al. ..... 52/235
4,650,702 A * 3/1987 Whitmyer ..... E06B 3/5427 428/31
4,680,206 A * 7/1987 Yoxon ..... E04B 2/90 156/109
4,689,928 A * 9/1987 Dutton ..... E04F 13/081 403/143
4,752,150 A * 6/1988 Salice ..... F16B 12/26 403/231
4,809,475 A * 3/1989 Emmer ..... 52/235
4,826,345 A * 5/1989 Salice ..... F16B 12/2063 403/231
4,854,098 A * 8/1989 Emmer ..... 52/204.593
5,199,236 A * 4/1993 Allen ..... 52/235
5,245,808 A * 9/1993 Grunewald ..... E06B 3/5427 52/204.593
5,253,459 A * 10/1993 Parinas et al. ..... 52/235
5,309,689 A * 5/1994 Croissant ..... 52/235
5,481,839 A * 1/1996 Lang et al. ..... 52/235
5,497,586 A * 3/1996 Dodd ..... E06B 3/025 49/413
5,540,514 A * 7/1996 Demars ..... B32B 17/10036 403/122
5,592,795 A * 1/1997 Rinehart et al. ..... 52/235
5,619,834 A * 4/1997 Chen ..... 52/509
5,632,125 A * 5/1997 Osanai ..... 52/235
5,687,524 A * 11/1997 Ting ..... E04B 2/965 52/235
5,893,245 A * 4/1999 Sekiguchi ..... E04F 13/0816 403/295
6,032,423 A * 3/2000 Takemura et al. ..... 52/235
6,105,319 A * 8/2000 Brunt ..... E06B 3/5436 52/204.593
6,141,923 A * 11/2000 Habicht et al. ..... 52/235
6,216,401 B1 * 4/2001 Emek ..... E06B 1/6046 49/322
6,333,085 B1 * 12/2001 Emek ..... E06B 3/2605 428/34
6,401,410 B2 * 6/2002 Kenny et al. ..... 52/235
6,442,911 B2 * 9/2002 Elmer ..... E06B 3/5436 403/388
6,509,071 B1 * 1/2003 Emek ..... E06B 1/6046 428/34
6,623,203 B2 * 9/2003 Kreyenborg et al. ..... 403/374.3
6,694,687 B2 * 2/2004 Elmer ..... E06B 3/5436 403/367
6,715,245 B2 * 4/2004 Lewkowitz ..... 52/208
6,804,920 B2 * 10/2004 Hogan ..... 52/235
7,134,247 B2 * 11/2006 Ting ..... 52/235
7,155,869 B2 * 1/2007 Wildenhain ..... B32B 17/10036 403/115
7,213,375 B2 * 5/2007 Morgan et al. ..... 52/204.6
7,416,772 B2 * 8/2008 Rinehart et al. ..... 428/99
7,603,820 B1 * 10/2009 Lai ..... E06B 3/5436 403/56
7,882,675 B2 * 2/2011 Lundgren ..... 52/656.5
2002/0043034 A1 * 4/2002 Wildenhain et al. ..... 52/232
2003/0066256 A1 * 4/2003 DeBlock ..... B32B 17/10 52/208
2003/0188498 A1 * 10/2003 Lewkowitz ..... 52/208
2003/0205009 A1 * 11/2003 Herbst ..... E04F 13/0889 52/235
2004/0068943 A1 * 4/2004 Morgan et al. ..... 52/235
2004/0079038 A1 * 4/2004 Crooker, Jr. ..... 52/235
2004/0099778 A1 * 5/2004 Hogan ..... 248/261
2004/0234730 A1 * 11/2004 Rinehart et al. ..... 428/192
2005/0060950 A1 * 3/2005 Hauschildt et al. ..... 52/235
2006/0075702 A1 * 4/2006 Billings ..... 52/235
2006/0144008 A1 * 7/2006 Fouch et al. ..... 52/720.1
2007/0125014 A1 * 6/2007 Eckelt ..... B32B 17/10 52/204.5
2007/0190282 A1 * 8/2007 Erban ..... B32B 17/10036 428/49
2007/0193142 A1 * 8/2007 Franceschet ..... 52/234
2008/0017780 A1 * 1/2008 Downey ..... E04B 1/82 248/610
2008/0053023 A1 * 3/2008 Stenvall ..... E06B 3/5436 52/474
2008/0134597 A1 * 6/2008 Rinehart et al. ..... 52/204.62
2008/0138564 A1 * 6/2008 Rinehart et al. ..... 428/99

* cited by examiner

STRUCTURAL GLASS ASSEMBLIES

CROSS REFERENCE TO RELATED APPLICATIONS

This Application is a divisional application of U.S. Ser. No. 13/138,434, which is a US National Phase application of PCT/GB2010/050260 filed Feb. 17, 2010. U.S. Ser. No. 13/138,434 is hereby incorporated by reference as if set forth in its entirety herein. U.S. Ser. No. 13/138,434 was pending as of the filing date of this application.

BACKGROUND OF THE INVENTION

The present invention relates to a glazing system for a building, to mountings and fittings for use in such glazing systems to secure a glazing panel to a building, and to methods of improving the impact resistance of a glazing panel.

Frameless glazing systems for buildings are well known. Buildings incorporating a structural glass façade or curtain wall incorporating the Pilkington PLANAR™ glazing system are one such example. This type of structural glazing system comprises a plurality of glazing panels ranging typically in size between 1 m×1 m and 2.5 m×4.5 m, wherein each glazing panel is independently secured to an adjacent support structure via mechanical mountings and fittings. Each glazing panel usually comprises a sheet of glass that has been toughened and may be laminated to meet specific legislative requirements. Each glazing panel may be double or triple glazed to provide increased environmental performance.

In such frameless glazing systems, each glazing panel usually has a number of holes drilled through it, which may be straight or countersunk bores, for securing a mechanical fitting thereto. For a rectangular glazing panel the fixing holes or bores are usually in the vicinity of each corner and a mechanical fixing is connected to the glazing panel via each bore. Depending upon the size of the glazing panel, additional holes may be located at other positions around the periphery of the panel.

A glazing fitting passes through a bore in the glazing panel and is secured to the glazing panel by a suitable screw assembly. The glazing fitting usually has a hook that projects into the interior of the building. The hook is then connected to a suitable mounting comprising a mounting member that is secured to a suitable adjacent structural support element forming part of the building. The glazing fitting and mounting member are usually made of the same grade of stainless steel although mechanical strengths can be varied as required by design. An assembly comprising such a glazing fitting and mounting are used with the Pilkington PLANAR™ structural glass systems, commercial examples of such assemblies being known as 905 fittings.

When used as an exterior wall or façade on a building, such glazing fitting and mounting assemblies are specified by the engineer to be of sufficient strength to support the applied wind load. Equally, the two elements of the assembly are designed with sufficient tolerance and clearances to provide for adequate thermal expansion and building movement by rotation and translation of the mounting member within the glazing fitting which is attached to the glazing panel.

However for certain weather conditions the pure mechanical strength of an assembly designed in a conventional manner for wind load, thermal expansion and building movement is not sufficient. For example, in hurricane conditions, where airborne debris can impact upon the glazing panels, the standard mechanical assembly may not have sufficient strength or flexibility to withstand such a mechanical impact.

The impact resistance of a glazing system is influenced by many factors, for example, the material from which the glazing panel is made (which is usually glass), whether the glazing panel is laminated or not, the type of interlayer material specified for the laminate and the size of the glazing panel.

For a glazing panel comprising a single glass sheet, toughening the glass sheet (either thermally or chemically) strengthens the glass sheet thereby improving impact resistance. Thermally toughened glass sheets may be heat soaked to avoid potential problems with nickel sulphide inclusions. A glazing panel comprising two glass components and an interlayer material such as PVB is another known method of improving impact resistance. Dependent upon the particular application, for a glazing panel to be classified as impact resistant, the panel will usually be required to meet certain legislative standards by passing recognised test methods appropriate to the application.

To be classed as hurricane impact resistant in certain states of the USA, the glazing system must comply with specific Building Codes. In particular, the International Building Code (IBC), the International residential Code (IRC), the Florida Building Code (FBC) and the Texas Department of Insurance (TDI) form a central part of the minimum building standards designed to protect buildings from high wind events such as hurricanes. This family of building codes considers, amongst other things, curtain walls as part of the building envelope which may therefore be subjected to damage from flying debris during a high wind event. Prevention of a building envelope breach is critical not only to the continued structural integrity of the building due to resultant over pressurisation, but also to the protection of the building contents and occupants. Internationally recognised standard ASTM E 1996-08 provides a standard specification for defining the performance of a glazing system when impacted by windborne debris in a hurricane.

At present hurricane impact performance of windows has been improved by using laminated glazing panels. A typical hurricane impact resistant laminated glass panel comprises an interlayer material bonded between two panes of glass. A particularly suitable interlayer material is available from Du Pont™ and is sold as SentryGlas®. Compared to a conventional PVB interlayer, SentryGlas® is more rigid and tough and is therefore able to contribute to the increased ability of a glass panel to remain unbreached and in place when subjected to the above mentioned impact tests.

For a glazing panel comprising a glass sheet that is supported by mechanical fittings via holes in the glazing panel rather than being fitted into a conventional frame, the limiting factor for the glazing panel wind load capacity and impact resistance becomes the area of glass and interlayer which is in the immediate vicinity of the holes through which the glazing fittings pass. In this area surrounding the hole, the interlayer and glass are both vulnerable to higher localised loads, distortions and stresses. This makes achieving the required level of wind load and impact performance for such a glazing assembly difficult.

This type of generic bolted system has previously been known to secure panes of glass in the construction of frameless display cases, shop windows, feature glazing for commercial buildings and the like. One example of such a generic bolted system is described in GB 311,616. The shank of a screw passes through a hole in a glass sheet and is screwed into a clip. A rubber washer backed by a metal washer is placed under the screw head and the glass pane is secured by the clip and the washers. Such an attachment assembly is not suitable for providing a glazing assembly that will pass current impact legislation, in particular the hurricane high wind load and impact tests mentioned above.

In JP08-333,831A a fastener for a wall body panel is disclosed. The fastener is used to improve the wind resistance of the panel. For a wind load applied substantially normal to the body panel, the fastener allows the body panel to move in the direction of the applied wind load.

FR 2 738 271 discloses a fixing for attaching a glass panel to a building. The fixing has a support shaft having a bulged portion along the central portion thereof. A glazing fitting having a hook portion is attached to a glass panel and the fixing is connected to the hook portion via the bulge portion. Such a fixing finds particular application against the effects of wind load.

It is possible to improve the impact performance of a laminated glazing panel by using an interlayer that extends beyond the panes of glass in the laminate, as described in US2003/0188498A1. The exposed interlayer is then bonded into the surrounding framework or onto adjacent metal lugs forming part of the framework. This solution is not possible for a frameless glazing assembly of the type described above, because there is no frame surrounding each glazing plane into which the interlayer can be bonded.

Another solution described in the October 2007 edition of Glass Magazine is to bond a glazing fitting onto a face of the glazing pane using a strong structural adhesive, thereby eliminating the need to have any holes in the glazing panel at all and the associated vulnerabilities. Such systems have been developed for frameless glazing systems such as curtain walls and façades, but require the use of specialist adhesives that are applied in controlled environments to achieve the necessary durability and UV stability of the connection. There can be high costs associated with such a method.

SUMMARY OF THE INVENTION

The present invention aims to provide an alternative solution to the problem of improving the impact resistance of a glazing panel, in particular a glazing panel comprising a glass sheet and having a mechanical fitting secured thereto via a bore therein.

Accordingly the present invention provides from a first aspect a glazing system for a building comprising a glazing panel, a support and an attachment assembly for attaching the glazing panel to the support, the attachment assembly comprising a mounting secured to the support and a glazing fitting secured to the glazing panel, the mounting comprising a mounting member and the glazing fitting comprising a hook portion, the mounting being connected to the glazing fitting by a connection between the hook portion and the mounting member, characterised in that the attachment assembly further comprises a shock absorber that allows the attachment assembly to move relative to the support upon applying an impact to the glazing panel, thereby improving the impact resistance of the glazing panel.

A shock absorber is used when one component is connected to another and provides the connection with the ability to dampen a shock wave and dissipate kinetic energy collected from a high velocity impactor.

Such a glazing system has an improved resistance to mechanical impact compared with other known glazing systems.

Preferably the mounting is secured to the support by a securing member that passes through a bore in the support, and the shock absorber surrounds the securing member.

Preferably the shock absorber is located in the bore in the support.

In some embodiments, the shock absorber is mounted on a hollow rigid member.

In some embodiments, the shock absorber is substantially annular.

Preferably the shock absorber is compressible. Preferably the shock absorber comprises at least one rubber ring.

In a most preferred embodiment the shock absorber comprises three rubber o-rings.

Suitably the shock absorber is physically separate from the mounting member.

In another preferred embodiment, the shock absorber is associated with the hook portion of the glazing fitting. Suitably the shock absorber is an integral component of the glazing fitting.

Embodiments of the first aspect of the invention have other preferable features. Preferably the mounting member is connected with the glazing fitting such that upon applying an impact to the glazing panel the glazing fitting can rotate relative to the mounting member. Preferably the mounting member has a bulbous portion and the glazing fitting is connected to the mounting member via the bulbous portion.

Preferably the glazing panel comprises a laminate material. Preferably the glazing comprises a glass sheet bonded to the laminate material. Preferably the laminate material is of a type used to provide a hurricane impact resistant glass panel. Preferably the glass panel passes ASTM E 1996-08. Suitably the glazing panel passes impacts as defined by ASTM E 1996-08 with a large missile type ranging from performance levels A through D.

Preferably the glazing system is part of a structural façade or curtain wall.

Preferably the glazing system is part of a building.

Suitably the shock absorber is irreversibly compressible.

Suitably the glazing panel comprises a glass sheet having a bore therein, and the glazing fitting is secured to the glazing panel via the bore.

The glazing panel may be an insulating unit. The glazing panel may comprise two spaced sheets of glass with a peripheral edge seal thereby defining an air gap between the two glass sheets. The insulating unit may comprise three glass sheets.

The present invention also provides from a second aspect a mounting for attaching a glazing panel to a building, the mounting being configured to be secured to the building by a securing member that passes through a bore in a structural element of the building, the mounting comprising a mounting member being connectable with a glazing fitting secured to the glazing panel, the glazing panel being attachable to the building by connecting the mounting member to the glazing fitting, wherein there is a shock absorber associated with the mounting configured such that when the glazing panel is attached to the building, the glazing panel has an improved impact resistance, characterised in that the shock absorber is locatable in the bore in the structural element.

Preferably the shock absorber is compressible.

Preferably the shock absorber is mounted on a hollow rigid member that is locatable in the bore in the structural support element, wherein the hollow rigid member is configured such that the securing member is able to pass through the hollow rigid member. This has the advantage that the support member may be secured to the structural support element without compressing the shock absorber, whilst still maintaining a sufficiently rigid connection with the structural element.

In some embodiments, the mounting is connectable with the glazing fitting such that upon applying an impact to the glazing panel the mounting member is rotatable relative to the glazing fitting. This provides the advantage that the applied impact may be further dissipated by movement of the glazing panel.

In other embodiments, the mounting member has a stem portion that has a bulbous portion along the length thereof. Preferably the mounting member is connectable with the glazing fitting via the bulbous portion.

Embodiments according to the second aspect of the invention have other preferable features. Preferably the shock absorber is substantially annular. Suitably the shock absorber comprises a rubber ring. Suitably the shock absorber comprises 3 rubber o-rings. Preferably the glazing panel comprises a sheet of glass. Suitably the glazing panel has an improved impact resistance to a high speed large body impact.

Preferably the mounting member is configured such that upon applying a sufficiently high impact, at least a portion of the applied impact causes the mounting member to permanently distort. This has the advantage that at least a portion of the energy from the applied impact is dissipated in localized deformation of the mounting member.

Suitably the shock absorber is irreversibly compressible.

The invention also provides from a third aspect a glazing fitting for attaching a glazing panel to a building, the glazing fitting being securable to the glazing panel and having a hook portion, the glazing fitting being connectable with a mounting comprising a mounting member and being securable to the building, the glazing panel being attachable to the building by connecting the mounting member to the hook portion of the glazing fitting, wherein there is a shock absorber associated with the hook portion of the glazing fitting configured such that when the glazing panel is attached to the building, the glazing panel has an improved impact resistance.

Preferably the hook portion is connectable with the mounting member via the shock absorber.

In a preferred embodiment, the glazing fitting is configured to be securable to the glazing panel via a bore in the glazing panel.

Preferably the glazing panel comprises a sheet of glass.

Preferably the shock absorber is compressible. Suitably the shock absorber is irreversibly compressible.

The invention further provides from a fourth aspect an attachment assembly for use in attaching a glazing panel to a building comprising a mounting member according to the second aspect of the invention and a glazing fitting according to the third aspect of the invention.

Preferably the mounting member is connectable with the glazing fitting such that when the glazing fitting is secured to a glazing panel, the mounting member is substantially perpendicular to the glazing fitting.

The invention yet further provides from a fifth aspect a method of improving the impact resistance of a suspended glazing panel comprising the steps of (a) providing an attachment assembly for securing the glazing panel to an adjacent support, the attachment assembly comprising (i) a mounting having a mounting member and being securable to the adjacent support, and (ii) a glazing fitting for securing to the glazing panel, the glazing fitting having a hook portion, the glazing panel being attachable to the adjacent support by connecting the mounting member to the hook portion of the glazing fitting; (b) securing the glazing fitting to the glazing panel, preferably via a bore therein; (c) securing the mounting to the adjacent support by a securing member that passes through a bore in the support and the securing member passes through a bore in a shock absorber; and (d) connecting the mounting member to the hook portion of the glazing fitting; wherein the shock absorber is configured to allow the attachment assembly to move relative to the support upon the application of an impact to the glazing panel.

Steps (b) and (c) may be interchanged.

Preferably the shock absorber is located in the bore in the support.

Preferably the shock absorber is mounted on a hollow rigid member such that in order to secure the mounting to the support, the securing member passes through the hollow member.

In another embodiment the mounting member is connectable with the glazing fitting such that upon applying an impact to the glazing panel the mounting member can rotate relative to the glass assembly fitting. Preferably the mounting member comprises a stem portion having a bulbous portion and the mounting member is connectable with the glazing fitting via the bulbous portion.

In another embodiment, the shock absorber is associated with the glazing fitting. Preferably the glazing fitting comprises a hook portion and the shock absorber is associated therewith, such that the glazing fitting is connected to the mounting member via the shock absorber.

Preferably the shock absorber is compressible.

In other preferred embodiments of the fifth aspect of the invention, suitably the shock absorber is irreversibly compressible. Preferably the glazing fitting is secured to a bore in the glazing panel. Suitably the glazing panel comprises a sheet of glass. Suitably the glazing panel is a window in a building.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
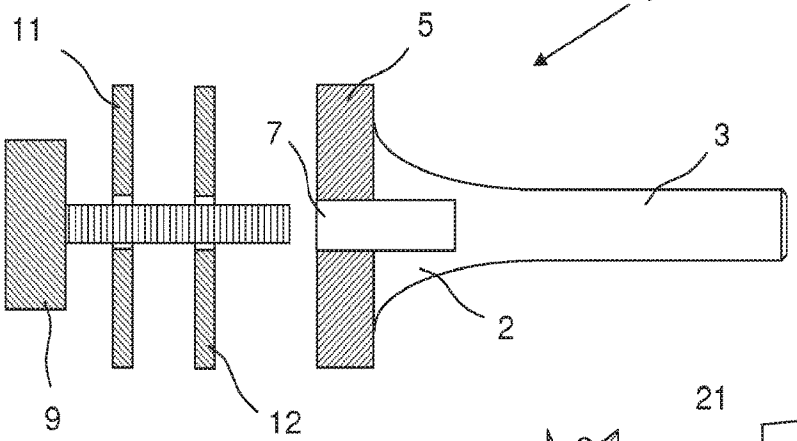
Fig. 1 Prior Art
FIG. 1 shows a cross sectional side view of conventional mounting that is connectable with a glazing fitting and is used to attach a glazing panel to a building.

FIG. 1 shows a conventional mounting 1 used for attaching a glazing panel to a building when installing a frameless glazing system such as a curtain wall or façade. The mounting 1 comprises a mounting member 2 that is made of a suitable grade stainless steel. The mounting member 2 is sufficiently rigid to be used in an attachment assembly for attaching a glazing panel to a building. The mounting member 2 has a stem portion 3. The stem portion 3 extends from and is integral with a cylindrical base portion 5. The mounting member 2 is symmetrical about a central axis extending along the stem portion 3. Located along the axis of the mounting member 2 is a blind threaded bore 7, of suitable diameter to receive a securing bolt 9. The securing bolt may also be made of the same grade stainless steel as the mounting member. The mounting member 2 may be secured to a structural element or support (not shown) in a building by passing the bolt 9 through a bore in the structural element and screwing the bolt 9 into the blind threaded bore 7. Washers 11 and 12 may be used on either side of the structural element. The washers may also be made of the same grade stainless steel as the mounting member. The mounting member 2 is often referred to as a mounting rod.

For this particular mounting 1, the stem portion 3 has a diameter of about 13 mm and a length of about 45 mm. The cylindrical base portion 5 has a height of about 10 mm and a diameter of about 40 mm. The cylindrical base portion and the stem portion are physically connected, having been machined from a single piece of stainless steel. The blind bore 7 has a diameter of about 11 mm and a depth of about 25 mm.

Figure 2:
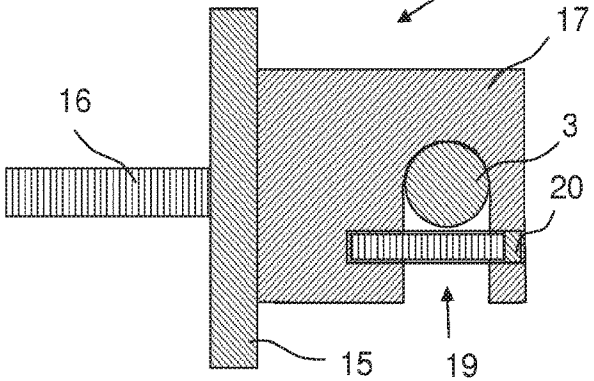
Fig. 2 Prior Art
FIG. 2 shows a cross sectional side view of a conventional glazing fitting connected to the mounting member shown in FIG. 1.

FIG. 2 shows a conventional glazing fitting 13 for securing to a glazing panel through a hole or bore in the glazing panel. This type of glazing fitting is used to attach a glazing panel to a building when installing a frameless glazing system such as a curtain wall or façade. Usually the glazing panel comprises a glass sheet. The glazing fitting 13 is usually made of the same grade stainless steel as the mounting member 2 described with reference to FIG. 1, although the mechanical strength of the material chosen for the glazing fitting may be specified to be different if required by design. The glazing fitting 13 has a cylindrical base portion 15 that is configured to be adjacent to the glazing panel. A securing screw 16 is provided for securing the glazing fitting to a bore in a glazing panel. A suitable nut assembly (not shown) may be used to secure the glazing fitting 13 to the glazing panel. Other similar methods of securing the glass support fitting to a bore in a glazing panel are known to one skilled in the art.

Extending from and integral with the base portion 15 is a cylindrical portion 17 having a substantially horizontal groove 19 therein defining a hook. The groove 19 is sufficiently sized such that the stem portion 3 of the mounting member 2 can engage with the hook. A retaining screw 20 prevents vertical movement of the glazing fitting relative to the mounting member and retains the glazing fitting on the stem portion of the mounting member in the event of glass breakage.

Figure 3:
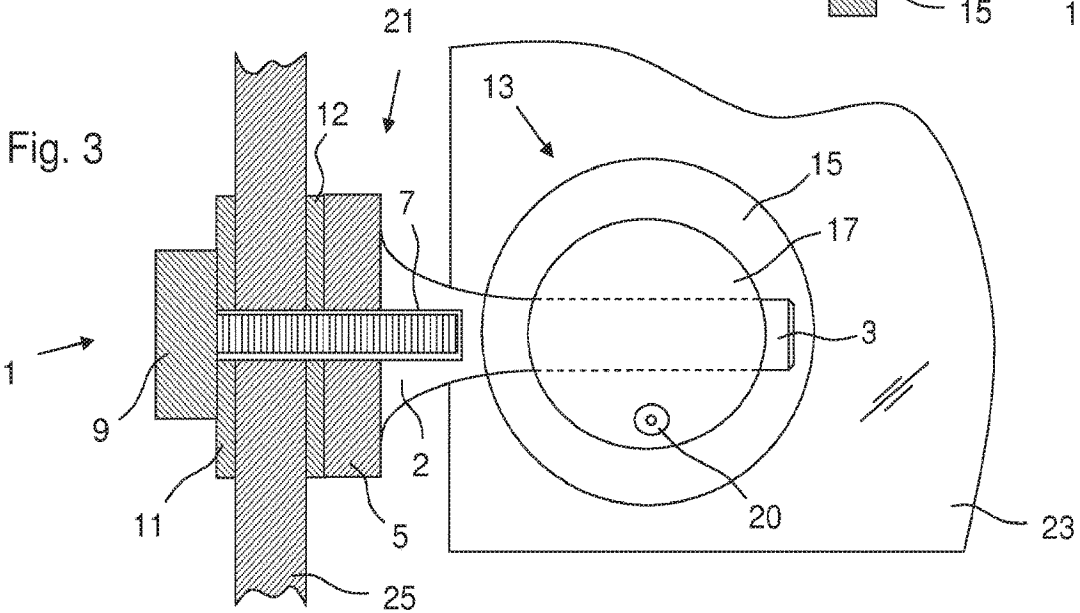
FIG. 3 shows a partial cross sectional side view of a conventional glazing system wherein an attachment assembly is shown attaching a glazing panel to a structural support member of a building.

FIG. 3 shows a known glazing system. A conventional mechanical attachment assembly 21 is shown attaching a glazing panel 23 comprising a glass sheet to a support or structural element 25 in a building. This type of attachment assembly 21 is similar to a conventional Pilkington 905 fitting. The attachment assembly comprises a mounting 1 of the type described with reference to FIG. 1 secured to the structural element 25. The connection between the mounting and the structural element is rigid.

A glazing fitting of the type described with reference to FIG. 2 is secured to the glazing panel 23 via a hole or bore in the glazing panel. The stem portion 3 of the mounting member 2 is connected to the glazing fitting such that the glazing fitting is substantially perpendicular to the mounting member. The groove 19 may be suitably configured such that when the mounting is connected to the glazing fitting, the glazing fitting is not perpendicular to the mounting. The attachment assembly provides a rigid connection between the glazing panel 23 and the structural element 25.

The glazing panel may be of laminated construction or of insulated construction with a laminated inner component. The glazing panel may be double or triple glazed, in which case the details of the glazing fittings are modified as appropriate for fixing satisfactorily to such a glazing panel.

In use, the mounting 1 is secured to structural element 25 of the building, for example a structural mullion or a supporting truss. The cylindrical base portion 5 of the mounting member 2 may abut the structural element 25, or as is shown in FIG. 3, a stainless steel washer 12 may be placed in between the structural element 25 and the base of the cylindrical portion 5. A stainless steel washer 11 is placed on the other side of the structural element and the bolt 9 passes through the washers and a bore in the structural element. The washers 11 and 12 may be of other suitable material. The bolt 9 is screwed into the blind threaded bore 7 in the mounting member such that the mounting member is secured to the structural element rigidly.

The glazing fitting is suitably secured to the glazing panel in a manner known in the art. The glazing panel is then suspended from the stem portion 3 of the mounting member by connecting the stem portion to the hook. The retaining screw 20 is then inserted to prevent vertical movement of the glazing element and provides added security in the event of glass breakage.

Figure 4:
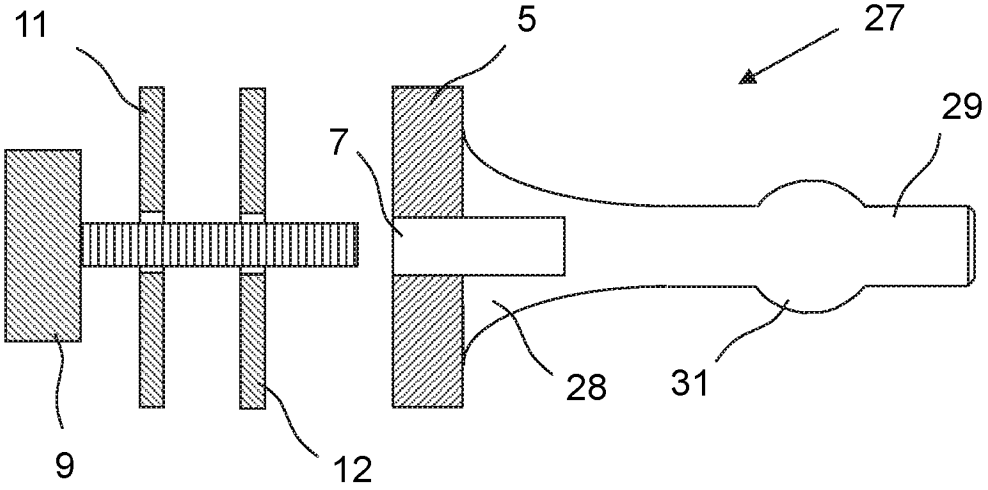
FIG. 4 shows a cross sectional side view of another conventional mounting for use in attaching a glazing panel to a building.

FIG. 4 shows another conventional mounting 27 used for attaching a glazing panel to a building when installing a frameless glazing system such as a curtain wall or façade. The mounting 27 is similar to the mounting 1 except there is a mounting member 28 that has a stem portion 29 with a bulbous portion 31 positioned along the length thereof. Typically the bulbous portion 31 is about half way down the length of the stem portion 29 and is positioned to be along the centre line of the glazing fitting when attached to the glazing panel.

Figure 5:
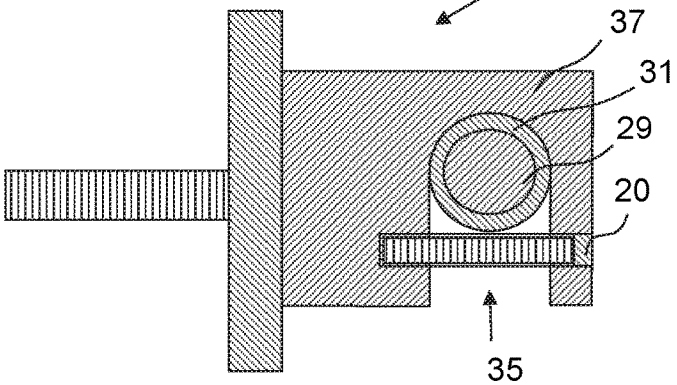
FIG. 5 shows a cross sectional side view of another conventional glazing fitting shown connected to the mounting shown in FIG. 4.

FIG. 5 shows another conventional glazing fitting 33 for securing to a glazing panel via a bore therein. The glazing fitting 33 is similar to the glazing fitting 13 except the groove 35 in the cylindrical portion 37 is sufficiently sized so that the hook is connectable with the bulbous portion 31 of the mounting member 28 of the type described with reference to FIG. 4.

Figure 6:
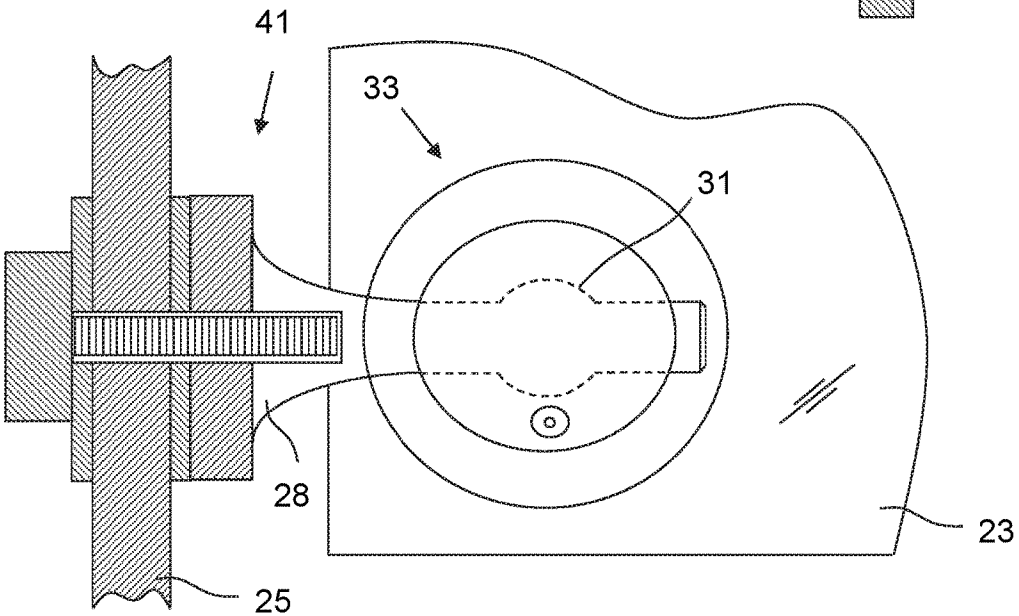
FIG. 6 shows a partial cross sectional side view of another conventional glazing system wherein another attachment assembly is shown attaching a glazing panel to a structural support member of a building.

FIG. 6 shows another known glazing system. A mechanical attachment assembly 41 is shown attaching a glazing panel 23 to a support or structural element 25 of a building. The attachment assembly 41 comprises a mounting 27 of the type referred to with reference to FIG. 4. The mounting 27 is secured to the structural element 25. The attachment assembly also comprises a glazing fitting 33 of the type described with reference to FIG. 5. The glazing fitting 33 is secured to the glazing panel 23 via a bore therein.

The mounting member 28 is connected to the glazing fitting 33 via the bulbous portion 31. As in the attachment assembly described with reference to FIG. 3, the glazing fitting 33 is connected to the mounting member 28 such that the glazing fitting 33 is substantially perpendicular to the mounting member 28.

This type of attachment assembly 41 provides a less rigid connection between the glazing panel and the structural element than the attachment assembly 21 shown in FIG. 3 because the bulbous portion 31 allows a degree of rotation of the glazing fitting 33 with respect to the mounting member 28. Consequently, this type of attachment assembly allows a degree of movement of the glazing panel 23 when the glazing panel is under high wind load.

Figure 7:
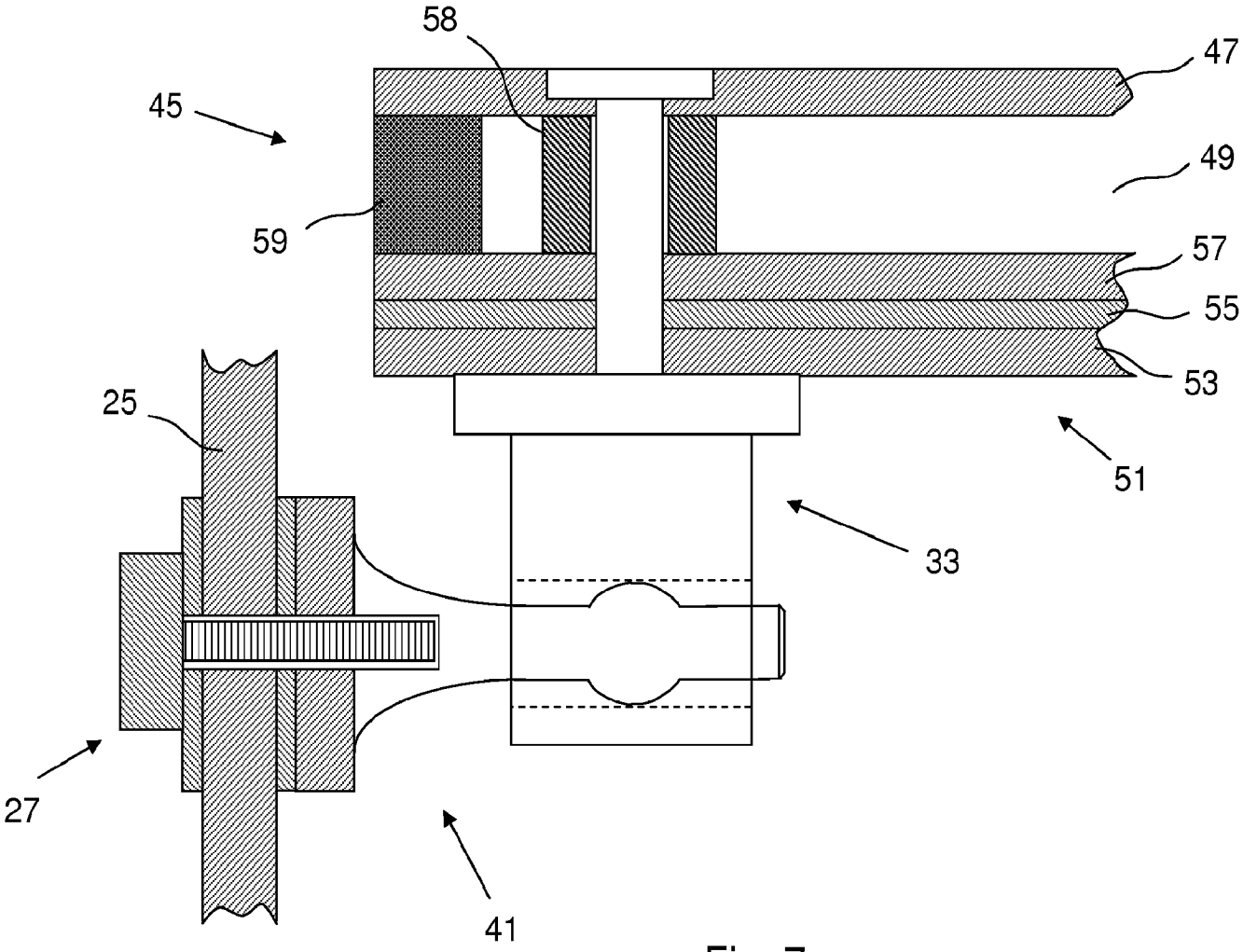
FIG. 7 shows a plan view of the glazing system shown in FIG. 6 and demonstrates the connection to an insulated unit with a laminated inner glass panel.

FIG. 7 shows a plan view of a glazing system incorporating the attachment assembly described with reference to FIG. 6. In this instance, the glazing fitting 33 is secured to a double glazed glazing panel 45 in a manner known to one skilled in the art. The glazing panel 45 comprises a 10 mm outer pane of toughened and heat soaked float glass 47, a 16 mm air gap 49, and a laminated pane 51 that is 20.3 mm thick. The laminated pane comprises a 10 mm thick sheet of toughened and heat soaked float glass 53 bonded to a layer of a laminate material 55 that is 2.3 mm thick. The laminate material may be PVB or Du Pont SentryGlas® or combinations thereof. The other face of the layer of laminate material 55 is bonded to a sheet of toughened and heat soaked float glass 57 that is 8 mm thick. A suitable sealant 59 extends around the periphery of the pane 47 and the pane 51 to define the air gap 49. Likewise, a silicone injected plastic boss 58 seals the bore which passes through the entire insulated unit. The holes in the interlayer and in the plastic boss are sized so as to entrap the interlayer in the event of all of the glass being broken so that the interlayer is still capable of sustained full structural loads. The attachment assembly shown in FIG. 3 may be used instead.

Figure 8:
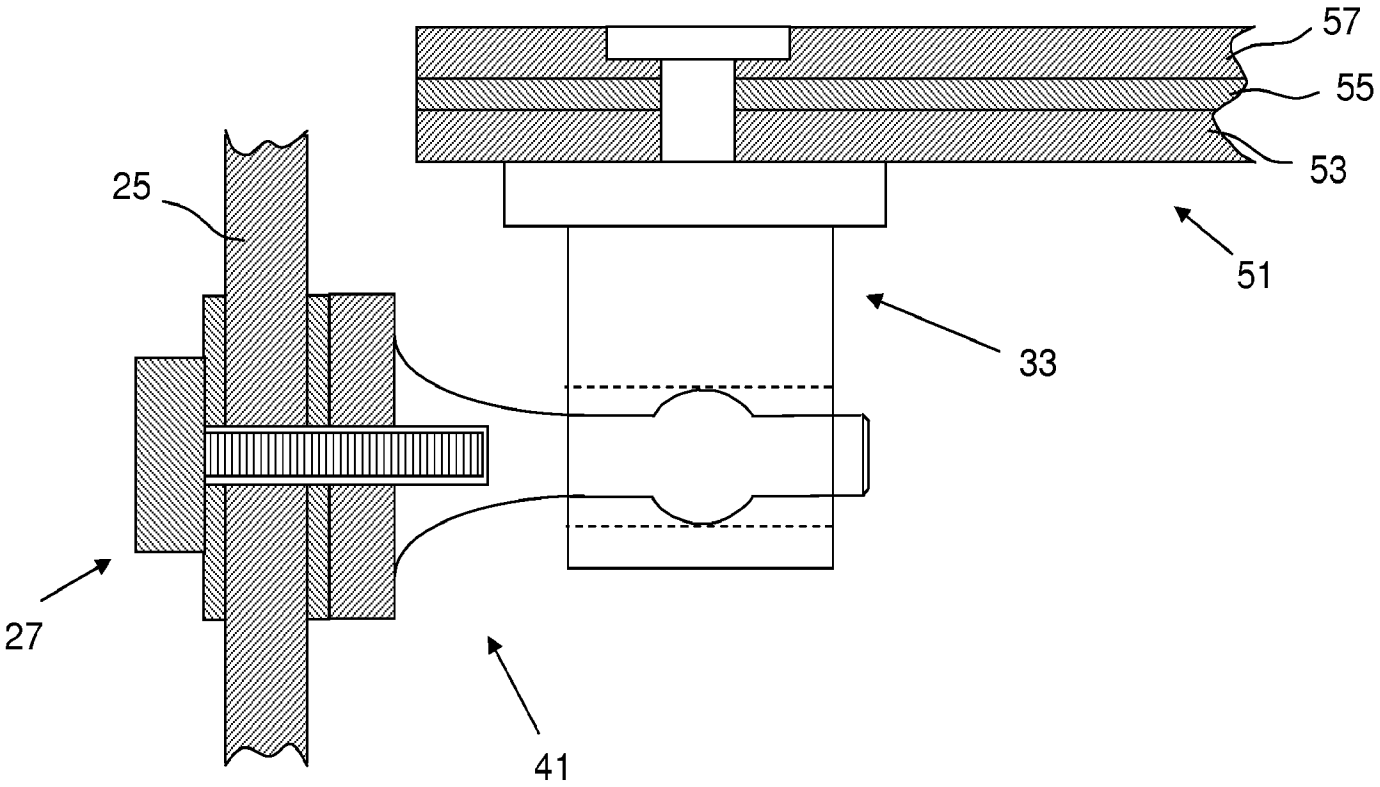
FIG. 8 shows a plan view of the glazing system shown in FIG. 6 and demonstrates the connection to a laminated glazing panel.

FIG. 8 shows a plan view of another known glazing system incorporating the attachment assembly described with reference to FIG. 6. In this instance, the glazing fitting 33 is secured to a laminated glazing panel 51. The glazing panel 51 is 20.3 mm thick. The laminated panel 51 comprises a 10 mm thick sheet of toughened float glass 53 (that may be heat soaked) bonded to a layer of a laminate material 55 that is 2.3 mm thick. The laminate material may be PVB or Du Pont™ SentryGlas®, or combinations thereof. The other face of the layer of laminate material 55 is bonded to a sheet of toughened and heat soaked float glass 57 that is 8 mm thick. The mounting 27 and glazing fitting 33 may be replaced with the mounting 1 and glazing fitting 13.

In both FIGS. 7 and 8, other thicknesses of glass sheet and laminate material may be used as required.

Figure 9:
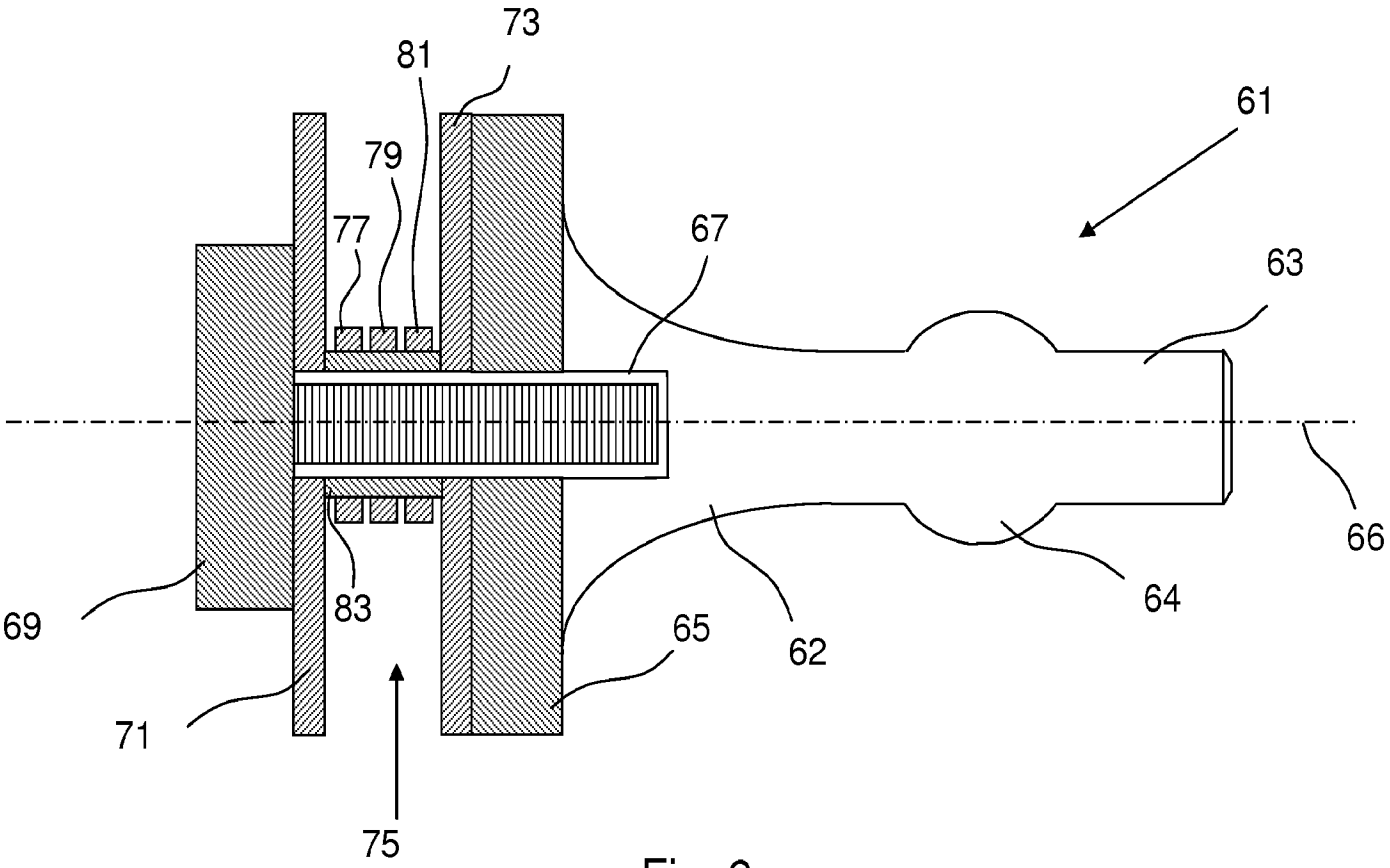
FIG. 9 shows a cross sectional view of a mounting in accordance with the second aspect of the invention.

FIG. 9 shows a mounting 61 in accordance with the second aspect of the invention. The mounting 61 comprises a mounting member 62 made of a suitable grade stainless steel and is similar to the mounting member described with reference to FIG. 4. The mounting member 62 has a stem portion 63. The stem portion 63 has a bulbous portion 64 about halfway down the length thereof. The stem portion extends from and is integral with a cylindrical base portion 65. Located along the central axis 66 of the mounting member 62 is a blind threaded bore 67, of suitable diameter to receive a securing bolt 69. The mounting may comprise washers 71 and 73 through which the bolt 69 can pass. The mounting 61 has radial symmetry about central axis 66.

The mounting 61 further comprises a shock absorber 75. A shock absorber is used when one component is connected to another and provides the connection with the ability to dampen a shock wave and dissipate kinetic energy collected from a high velocity impactor.

The shock absorber 75 comprises three rubber o-rings 77, 79, 81 mounted on a rigid stainless steel tube 83. The rubber o-rings are compressible, such that the shock absorber is able to deform under an applied load. Each rubber o-ring has an outer diameter of about 21 mm and an inner diameter of about 14 mm. The thickness of each o-ring is about 3.5 mm. Each o-ring has a substantially circular profile. The mounting 61 may be secured to a structural element in a building i.e. a truss or mullion by passing the bolt 69 through a bore in the structural element, passing the bolt through the washers and the bore in the stainless steel tube 83 and screwing the bolt into the blind threaded bore 67. The stainless steel tube 83 is slightly longer than the combined thickness of the three rubber o-rings 77, 79, 81. This allows the rubber o-rings 77, 79, 81 to remain uncompressed when the mounting is secured to a structural element in a building because the washers 71 and 73 abut the ends of the stainless steel tube 83.

As shown in FIG. 9, the shock absorber is physically separate to the mounting member 62. Incorporating a physically separate shock absorber provides the advantage that the shock absorber may be incorporated into existing mountings.

The stem portion 63 is shown having a bulbous portion (as described with reference to FIG. 4), such a bulbous portion enhancing rotation of the glazing fitting and aiding energy dissipation into the more ductile steel fitting thus providing increased impact resistance to the glazing panel. If required, the stem portion 63 may not have a bulbous portion.

Figure 10:
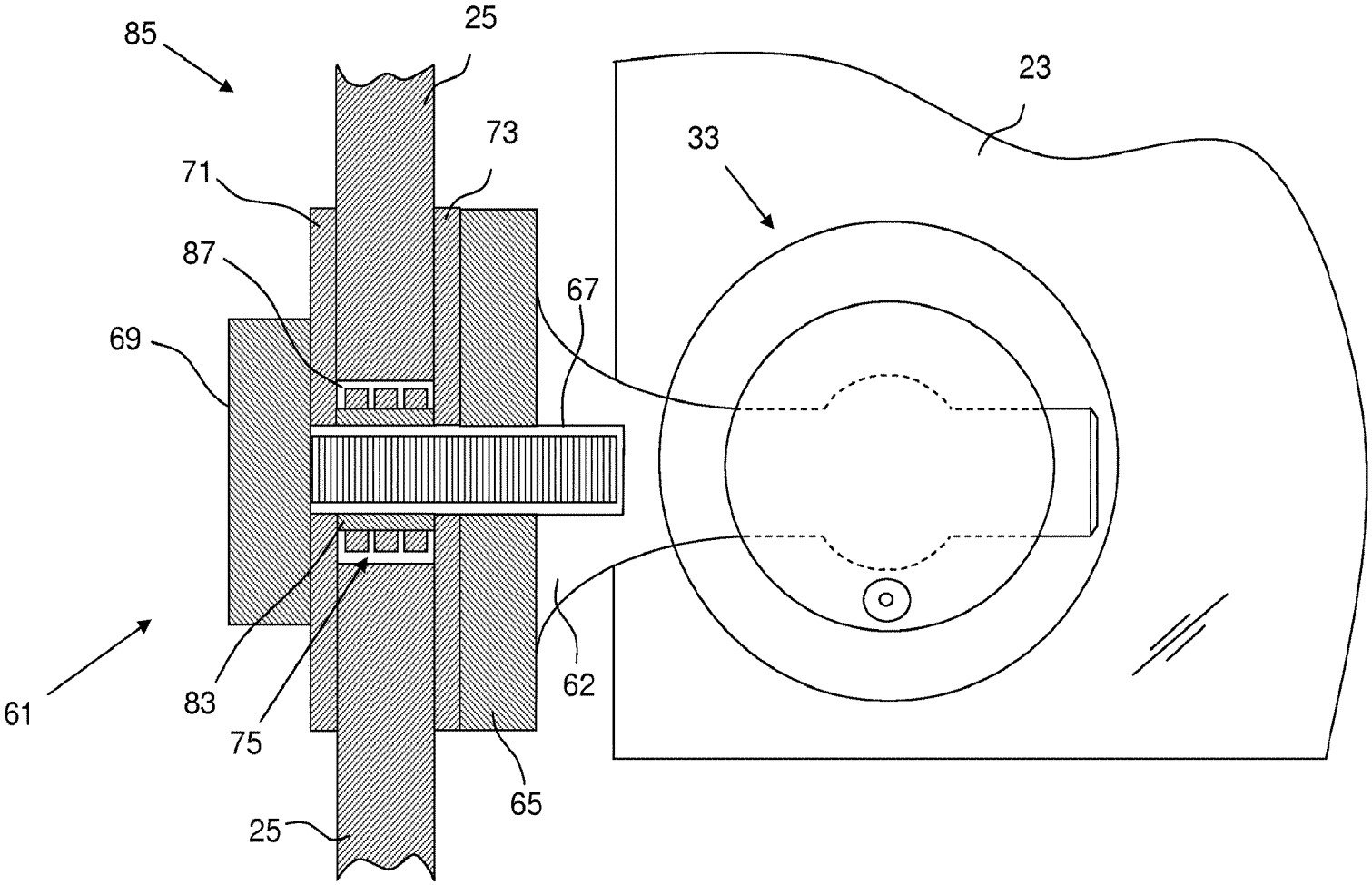
FIG. 10 shows a glazing system according to the first aspect of the invention.

FIG. 10 shows a glazing system in accordance with the first aspect of the invention. The glazing system comprises an attachment assembly 85. The attachment assembly 85 comprises a mounting 61 as described with reference to FIG. 9 and a glazing fitting 33 as described with reference to FIG.

5. The attachment assembly 85 is shown attaching a glazing panel 23 to a structural element 25 in a building. The glazing fitting 33 is secured to the glazing panel 23 via a bore therein. Alternatively, the glazing fitting may be suitably configured such that the glazing fitting is glued to the interior or exterior face of the glazing panel 23. The glazing panel may be an insulated unit or a laminated pane, of the type described with reference to FIGS. 7 and 8.

The mounting 61 is shown secured to the structural element 25. The flat face of the base portion 65 is shown adjacent to the washer 73, the washer 73 being adjacent to the structural element 25. In certain circumstances, washer 73 may not be present.

There is a bore 87 in the structural element 25. A washer 71 is positioned on the other side of the structural element, configured to be adjacent to the head of the securing bolt 69. The shock absorber 75 is located in the bore 87 in the structural element 25. The shock absorber 75 comprises three rubber o-rings. The o-rings are mounted on a stainless steel tube 83. The bolt 69 passes through the washer 71, through the stainless steel tube 83, through the washer 73 and is screwed into the blind threaded bore 67 in the mounting member 62, thereby securing the mounting 61 to the structural element 25.

The combined thickness of the three o-rings is slightly less than the length of the stainless steel tube 83 so that the stainless tube 83 is able to butt up against the washers 71, 73. The stainless steel tube allows the fitting to be sufficiently rigid in normal use and prevents the rubber o-rings from being compressed in normal use. The outer diameter of each o-ring is slightly less than the diameter of the bore 87 in the structural element such that the o-rings are rotatable in the bore 87 about the bolt 69. The inner diameter of the o-rings are such that the o-rings are a snug fit on the stainless steel tube 83.

When there is a mechanical impact against the exterior of the glazing panel (in a building the exterior of the glazing panel is that face exposed to the outside of the building), the rubber o-rings are compressible and are able to absorb some of the impact. In comparison, a rigid fitting cannot absorb sufficient impact. When the glazing fitting 33 is attached to a glazing panel via a bore, the bore is the weak point in the glazing panel. Consequently, a rigid attachment assembly between the glazing panel and the structural element of the building provides less impact resistance.

Figure 11A:
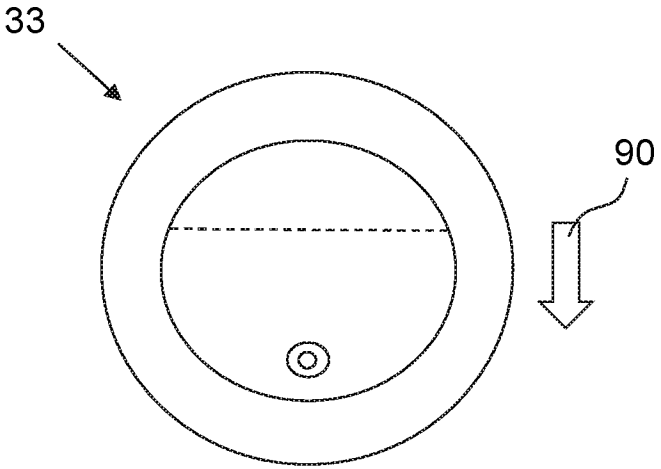
FIGS. 11*a* and 11*b* show an exploded view of the attachment assembly (without the glazing panel for clarity) shown in FIG. 10.
Figure 11B:
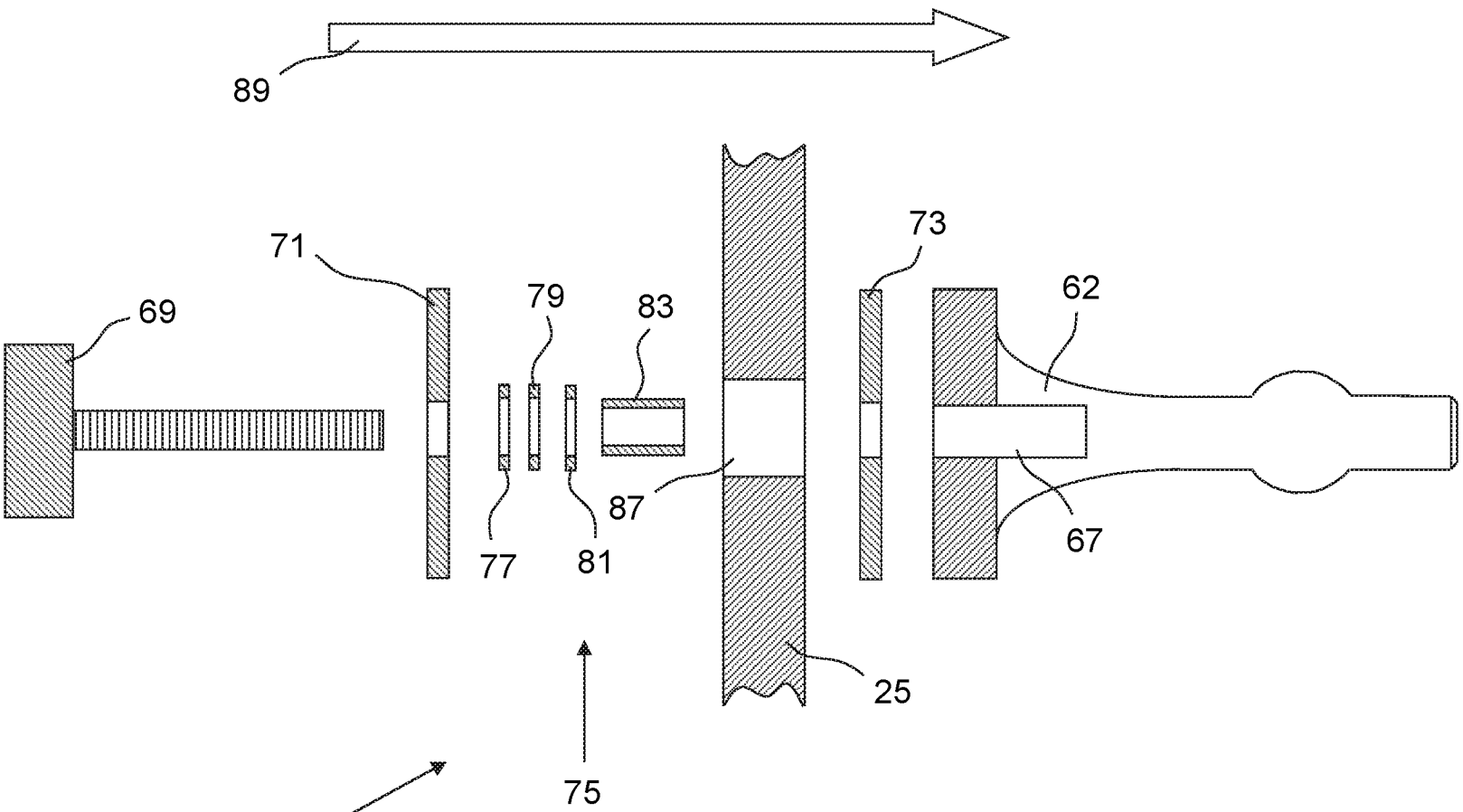

For clarity, an exploded version of the attachment assembly 85 is shown in FIGS. 11*a* and 11*b*. The attachment assembly is assembled as follows. The three rubber o-rings 77, 79 and 81 are placed over the stainless steel tube 83. The outer diameter of the stainless steel tube is similar to the inner bore diameter of the rubber o-rings so that the o-rings are a snug fit when mounted on the stainless steel tube 83. There may be one or more rubber o-ring. The shock absorber may comprise a rubber tube. The rubber tube may be mounted on a hollow rigid member such as a stainless steel tube.

The assembly of stainless steel tube 83 and o-rings 77, 79 and 81 is located in the bore 87 of the structural element 25. The bolt 69 is passed through the bore in the washers and the stainless steel tube (assembled in the direction of the arrow 89). The diameter of the bore in the stainless steel tube is sufficiently sized such that the tube is free to rotate about the bolt. The bolt is screwed into the blind bore 67 in the mounting member 62. This secures the mounting to the structural element.

The glazing fitting 33 is connectable (in the direction of the arrow 90) with the mounting member (of the type described with reference to FIG. 4), the glazing fitting being secured to a glazing panel via a bore therein.

Figure 12:
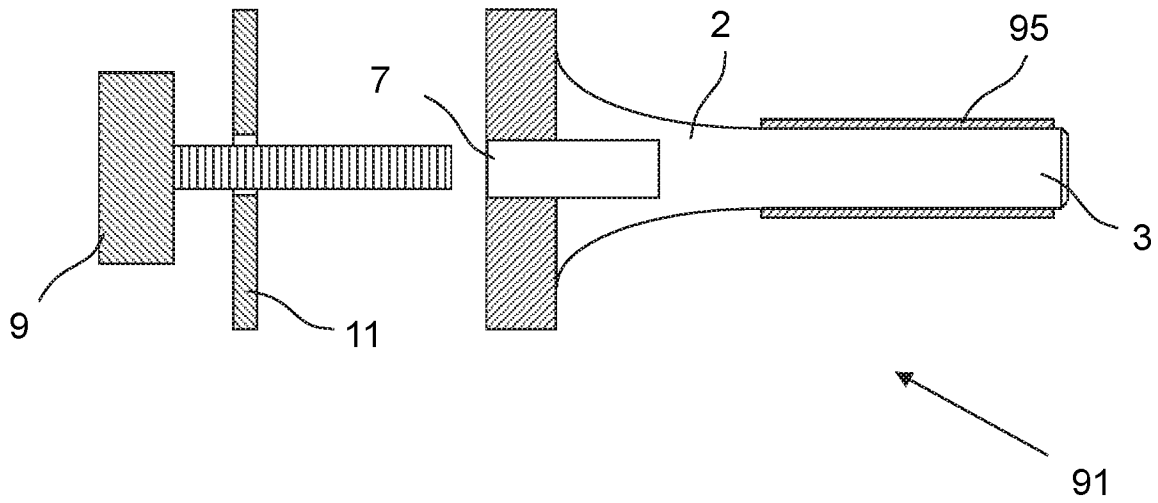
FIG. 12 shows a cross sectional side view of another mounting.

FIG. 12 shows another mounting 91. The mounting 91 comprises a mounting member 2 having a stem portion 3. There is a sleeve 95 of a compressible shock absorbing material covering a portion of the stem portion. The sleeve may completely surround the wall of the stem portion. The shock absorbing material may be irreversibly compressible to absorb impact.

The mounting may be secured to a support (not shown) by screwing bolt 9 into blind bore 7. A washer 11 may be used when securing the mounting to the support.

Figure 13:
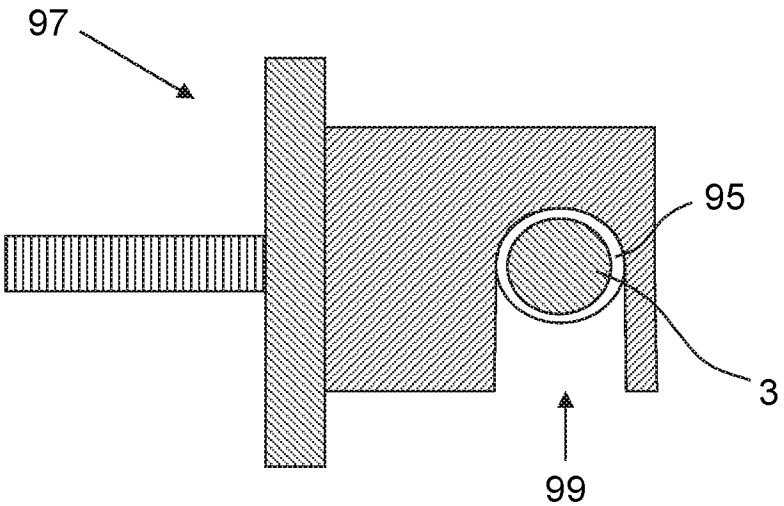
FIG. 13 shows a cross sectional side view of the mounting of FIG. 12 connected to a conventional glazing fitting of the type shown in FIG. 2.

FIG. 13 shows the mounting 91 connected to a glazing fitting 97 of the type described with reference to FIG. 2. The glazing fitting 97 has a slightly wider groove 99 defining the hook to accommodate the thickness of the sleeve 95.

Figure 14:
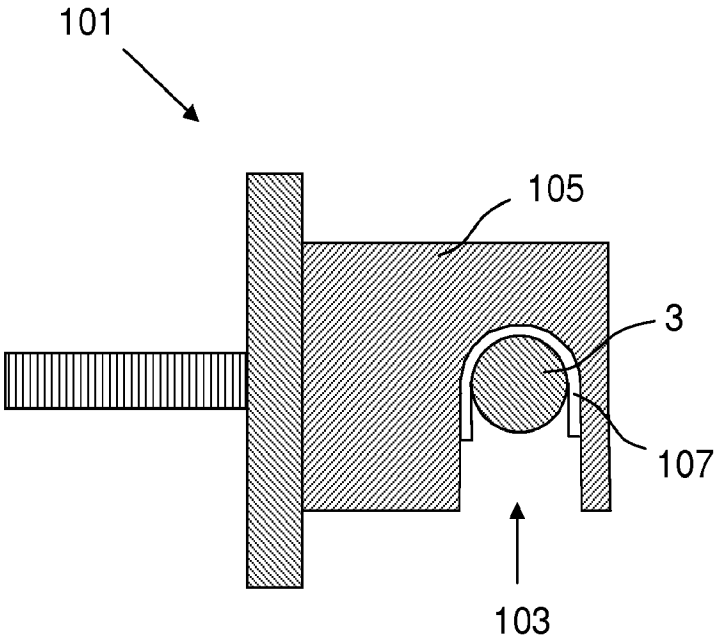
FIG. 14 shows a cross sectional side view of a glazing fitting in accordance with the third aspect of the invention connected to a conventional mounting member of the type shown in FIG. 1.

FIG. 14 shows a glazing fitting 101 in accordance with the third aspect of the invention. The glazing fitting 101 is configured to be secured to a glazing panel via a bore therein. The glazing fitting is similar to that described with reference to FIG. 2 except that a groove 103 in the cylindrical portion 105 that forms the hook has a shock absorber 107 associated therewith. When the stem portion 3 of a conventional mounting member (with reference to FIG. 1) is connected to the hook, the stem portion is in contact with the shock absorber 107. The shock absorber 107 is a 'U' shaped channel of rubber located in the base of the groove that defines the hook. Preferably the shock absorber 107 is fixed to the groove by an adhesive or the like.

Figure 15:
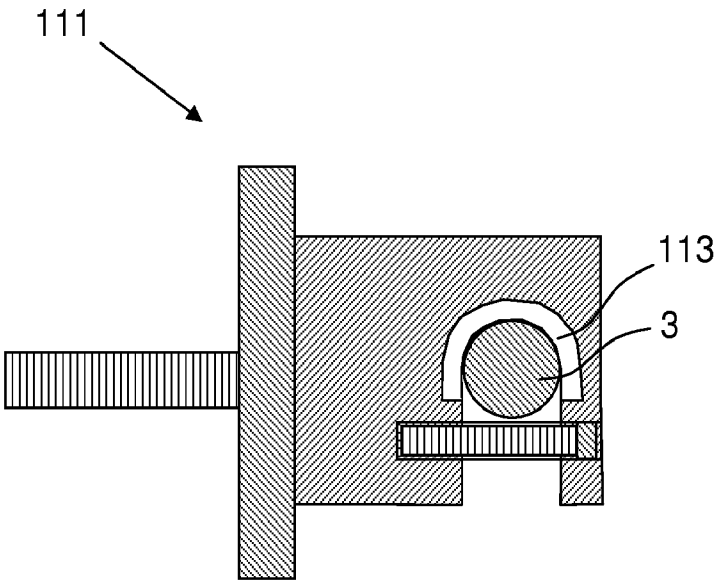
FIG. 15 shows a cross sectional side view of another glazing fitting in accordance with the third aspect of the invention connected to a conventional mounting member of the type shown in FIG. 1.

FIG. 15 shows an alternative glazing fitting 111 in accordance with the third aspect of the invention. In this particular embodiment, there is a shock absorber 113 located in a rebate inside the crescent of the hook so that the hook connects to the stem portion 3 of a conventional mounting member via the shock absorber 113. The shock absorber 113 is selected to have sufficient elasticity to be able to support the applied maximum wind loads whilst still absorbing the high energy of the mechanical impact as required. The shock absorber 113 may be secured in the rebate by a suitable adhesive.

In either of FIG. 14 or 15, a mounting as described with reference to FIG. 4 or 9 may be used.

Figure 16:
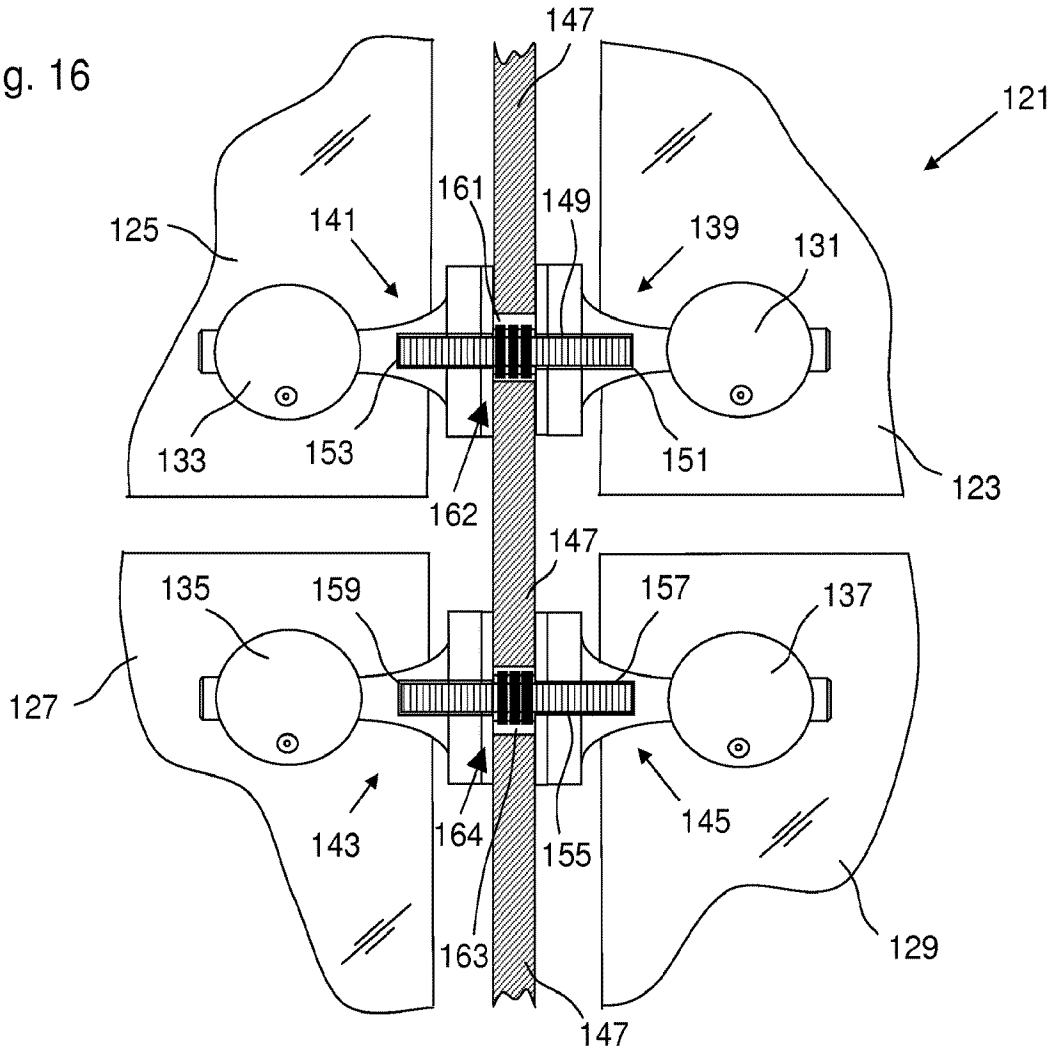
FIG. 16 shows a partial cross sectional view of a portion of a glazing system in accordance with the first aspect of the invention wherein four glass panels are connected at the corners to a structural element of a building.

FIG. 16 shows a schematic of a typical cruciform of a glazing system 121 in accordance with the first aspect of the invention. The glazing system comprises four glazing panels 123, 125, 127 and 129. A glazing fitting 131, 133, 135 and 137 of the type described with reference to FIG. 2 is secured to the corner of each respective panel 123, 125, 127, 129 via a bore in each respective glazing panel. A glazing fitting in accordance with the third aspect of the invention may be used in place of any or all of the glazing fittings shown in FIG. 16.

There are four mountings 139, 141, 143 and 145 of the type described with reference to FIG. 9 secured to a structural element 147. Each mounting has a respective mounting member as described with reference to FIG. 9. Each mounting member may not have a bulbous portion along the length of the stem portion. Since the glazing panels 123, 125, 127 and 129 are part of a larger façade, the structural element 147 could be a mullion or a truss.

The pair of mountings 139 and 141 are connected to the structural element 147 via a threaded member 149 that screws into a blind hole 151, 153 in each respective mounting member. Similarly, the pair of mountings 143 and 145 are connected to the structural element 147 via a threaded member 155 that screws into a blind hole 157, 159 in each respective mounting member of each mounting. Washers may be used either side of the structural element.

Located in the bore 161 in the structural element 147 is a shock absorber 162. Located in the bore 163 in the structural element 147 is a shock absorber 164. The shock absorber 162, 164 in each respective bore 161, 163 is three rubber o-rings mounted on a stainless steel tube and is as described with reference to FIGS. 9, 10 and 11. When viewed towards the major face of the panels (i.e. when viewed as shown in FIG. 16), each shock absorber 162, 164 is located outside of the periphery of each glazing panel. There is usually a seal around the periphery of each glazing panel such that the glazing system is sealed from the outside environment.

Each glazing panel 123, 125, 127, 129 may be laminated. Each glazing panel may be an insulated unit i.e. double or triple glazed.

Figure 17:
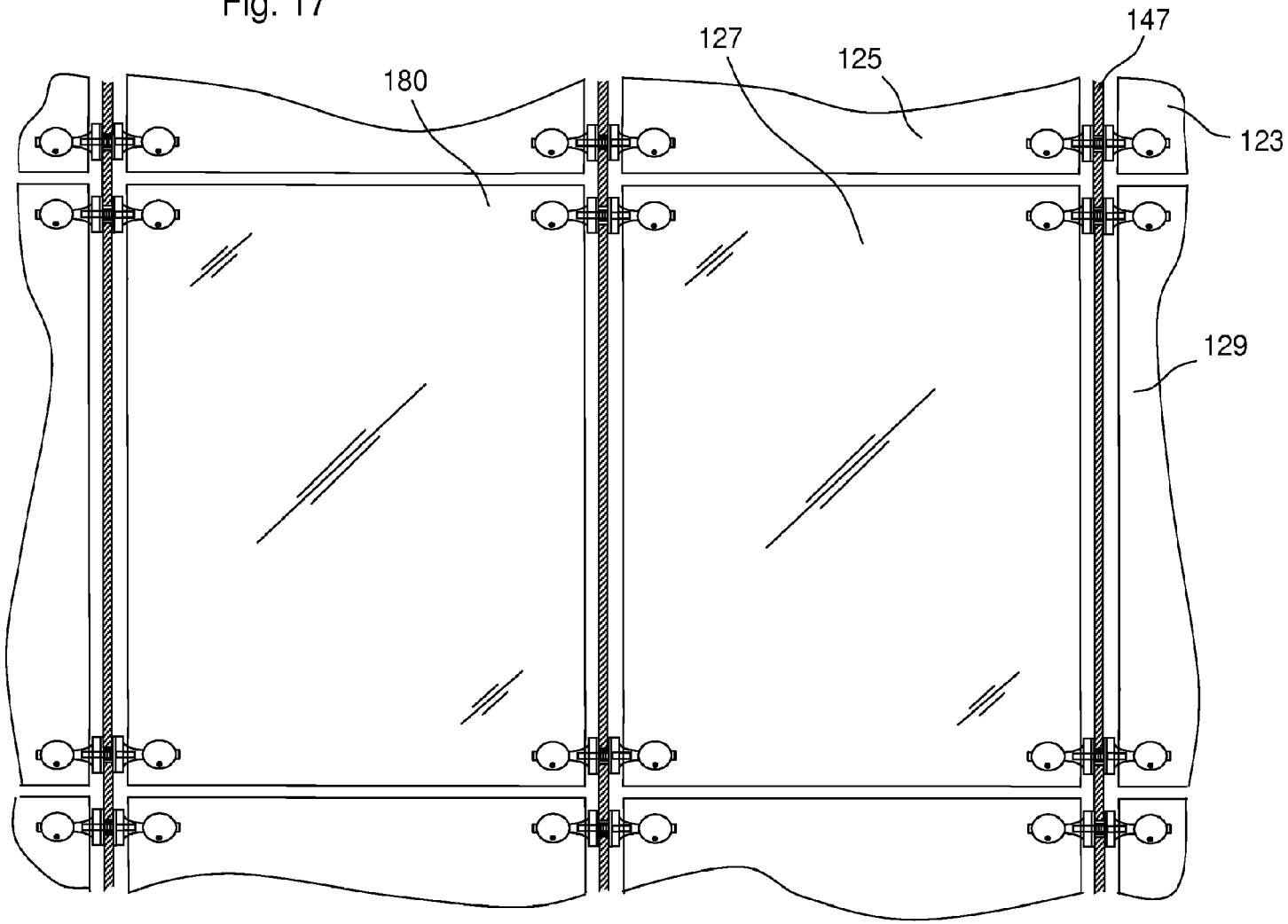
FIG. 17 shows a portion of a glazing system in accordance with the first aspect of the invention.

FIG. 17 shows more of the glazing system shown in FIG. 16. Each glazing panel has a glazing fitting in each corner thereof that is secured to the glazing panel via a bore therein. The figure shows two complete glazing panels 127 and 180.

Figure 18:
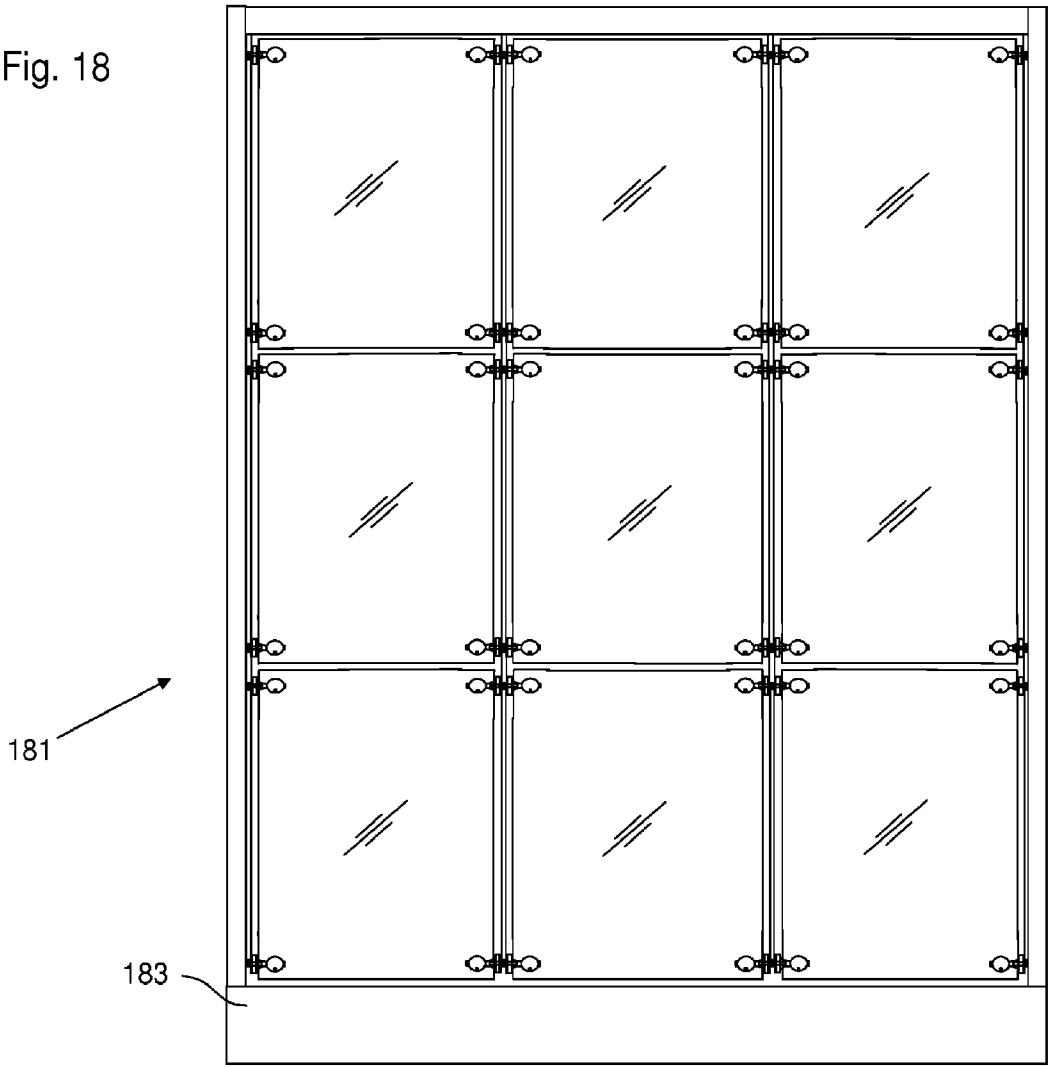
FIG. 18 shows a view of a glazing façade in accordance with the first aspect of the invention.

FIG. 18 shows a rear view (from inside a building) of a glazing façade 181 in a building 183. The façade is a type of glazing assembly as described with reference to FIGS. 16 and 17. The façade 181 has nine glazing panels. The central glazing panel is not attached to the peripheral jambs of the building but rather to a supporting mullion or truss which spans across the opening and provides structural support at the individual support points as required. Each glazing panel is attached to a structural element via an attachment assembly comprising a mounting as described with reference to FIG. 9 and a conventional glazing fitting as described with reference to FIG. 5. Depending upon the size of the glazing panels, glazing fittings and respecting mountings may be used at other positions in addition to the corners.

Figure 19:
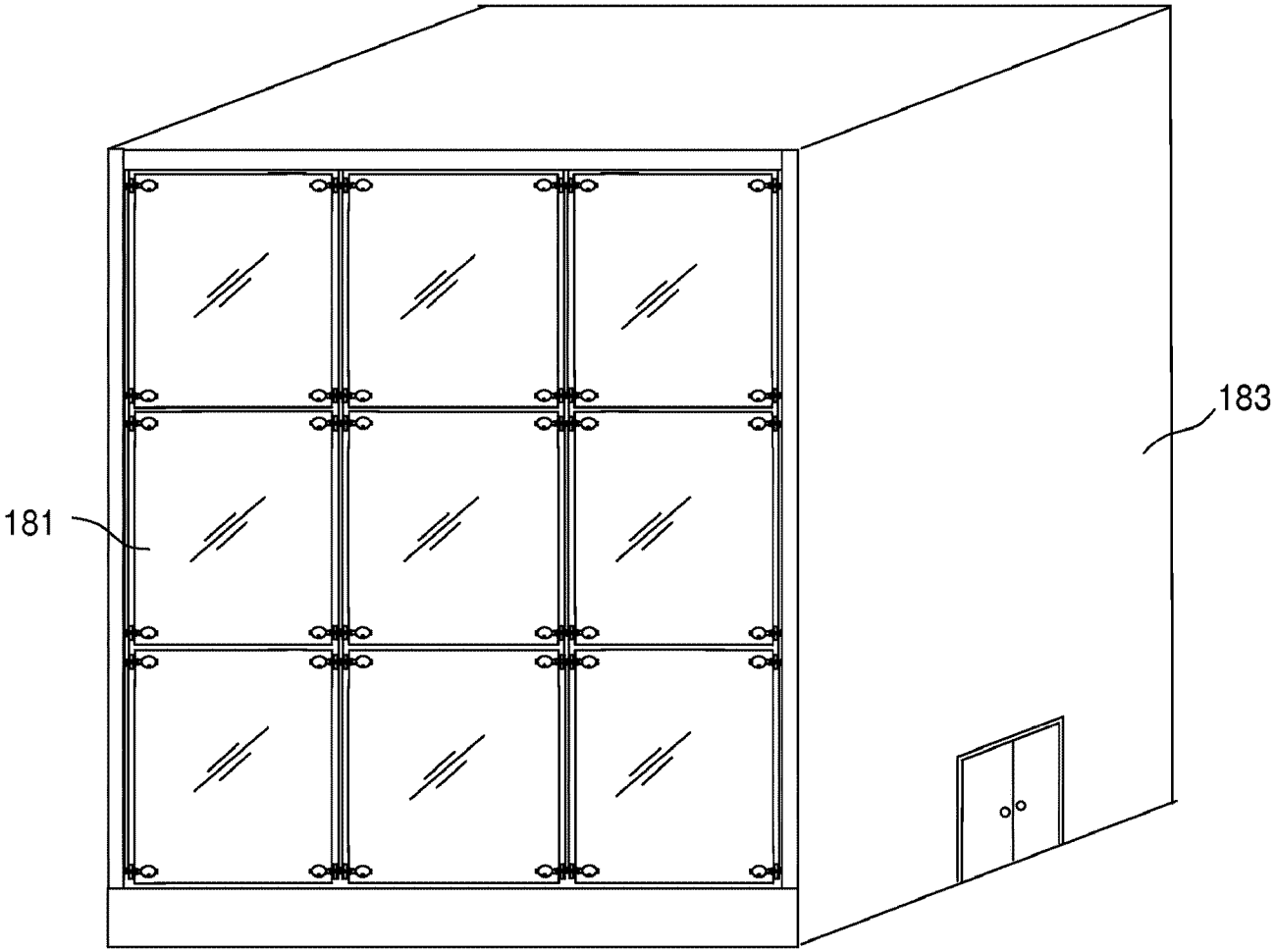
FIG. 19 shows a perspective view of a building having a glazing façade of the type shown in FIG. 18.

FIG. 19 shows a perspective view of the building 183 comprising a glazing façade 181 of the type described with reference to FIG. 18. The façade passes ASTM E 1996-08.

EXAMPLE

A glazing system consisting of nine glazing panels mounted to a support frame with attachment assemblies was constructed. Each attachment assembly comprised a single or pair of mountings similar to that shown in FIG. 9. A glazing fitting similar to that shown in FIG. 5 was attached to the glazing panels via bore holes. The nine panels were arranged into a rectangular glazing façade (as shown in FIG. 18) and were tested for hurricane resistance certification approval using the following standard test protocols:

Air infiltration test—TAS 202 (ASTM E283)

Uniform static load test—TAS 202 (ASTM E330) at +75 pounds per square foot (PSF) for 30 seconds Uniform static load test—TAS 202 (ASTM E330) at −75 PSF for 30 seconds Uniform static load test—TAS 202 (ASTM E330) at +100 PSF for 30 seconds Uniform static load test—TAS 202 (ASTM E330) at −100 PSF for 30 seconds Water leakage test—TAS 202 (ASTM E331) at 15 PSF for 15 minutes Uniform static load test—TAS 202 (ASTM E330) at +150 PSF for 30 seconds Uniform static load test—TAS 202 (ASTM E330) at −150 PSF for 30 seconds Large missile impact test—TAS 201 (ASTM E1996)

Cyclic load test—TAS 203 (ASTM E1996) at 100 PSF

The façade was similar to that shown in FIG. 18 and consisted of three rows, a lower row a central row and an upper row. The lower row consisted of three laminated glazing panels, each being five feet wide by five feet tall. The central row consisted of three laminated glazing panels, each being ten feet tall by five feet wide. The upper row consisted of three laminated glazing panels, each being five feet wide by five feet tall. The entire façade was twenty feet tall by fifteen feet wide. Each laminated glazing panel in the façade consisted of a 10 mm thick outer pane of toughened and heat soaked float glass, a 2.28 mm thick interlayer of Du Pont SentryGlas® Plus and an inner pane of 8 mm thick toughened and heated soaked float glass. The inner and outer panes were bonded to opposite faces of the interlayer. The inner pane is that pane meant for inside the building. The outer pane is the pane meant to be exposed to the outside environment.

The glazing panels in the lower and upper rows each had a glazing fixing secured to the panel via a bore in each corner. Due to the extra height of the glazing panels in the central row, these panels were each supported by eight glazing fittings, four fittings being equally spaced along each ten foot long edge (with glazing fittings in the corner of each glazing panel).

In accordance with ASTM E 1996-08, a 4.1 kg piece of 2×4 inch timber (type D large missile) was fired at the façade at pre-determined location on each glazing panel. The timber was fired at the glazing with a speed of 50 feet per second. This part of the testing schedule subjects the glazing panel to a localised mechanical impact.

This façade passed ASTM E 1996-08 with the type D large missile. The incorporation of the shock absorber in each mounting reduced the rigidity of the connection between the glazing panel and the structural support element. The bulbous portion on the stem portion of each mounting member also allowed the glazing panel to move and absorb energy when the impact from each missile was applied.

The stem portion of each mounting member may permanently distort due to the applied impact, such that energy from the impact is dissipated in localized yielding of the ductile steel material of the mounting member rather than immediate fracture of the brittle glass material. This provides the advantage that the destructive energy associated with the impact may be further dissipated into the glazing system by movement of the glazing panel and distortion of a relatively ductile stainless steel material.

The present invention finds application in providing a glazing façade that is hurricane resistant and passes ASTM E 1996-08, in particular when the glazing façade comprises a glazing panel having a glazing fitting secured thereto via a bore in the glazing panel. A glazing system in accordance with the first aspect of the present invention provides an improved resistance to a localised mechanical impact, such as that required by ASTM E 1996-08 with the type D large missile.

It will be readily apparent to a person skilled in the art that mountings according to the second aspect of the invention and glazing fittings according to the third aspect of the invention may be used with known glazing panels, such as single ply, laminated and insulated units.

The present invention may also find application in providing an improved impact resistance, for example to improve blast resistance i.e. due to explosions. For such explosive resistant applications, the properties of the shock absorber should be chosen so that the glazing panel passes the relevant test. Equally, application could be found in improving general impact resistance to the characteristic requirements defined in standards such as BS 6206 and BS EN356.

The invention claimed is:

1. A glazing fitting for attaching a glazing panel to a building, the glazing fitting being securable to the glazing panel, the glazing fitting having a groove therein, the glazing fitting being connectable with a mounting comprising a mounting member, the mounting being securable to the building, the groove having a shape which defines a hook portion, the glazing panel being securable to the building by connecting the mounting member to the hook portion of the glazing fitting, wherein there is a shock absorber fixed in the groove by an adhesive, and the glazing fitting is configured to be securable to the glazing panel via a bore in the glazing panel.

2. The glazing fitting according to claim 1, wherein the hook portion is connectable with the mounting member via the shock absorber.

3. The glazing fitting according to claim 1, wherein the shock absorber is compressible.

4. The glazing fitting according to claim 1, wherein the shock absorber is comprised of rubber.

5. The glazing fitting according to claim 1, wherein the shock absorber is irreversibly compressible.

6. The glazing fitting according to claim 1, wherein the shock absorber is selected to have sufficient elasticity to be able to support applied maximum wind loads while still absorbing energy of any anticipated mechanical impact.

7. A glazing fitting for attaching a glazing panel to a building, the glazing fitting being securable to the glazing panel, the glazing fitting having a groove therein, the groove having a recess portion, the glazing fitting being connectable with a mounting comprising a mounting member the mounting member being securable to the building, the groove having a shape which defines a hook portion, the glazing panel being attachable to the building by connecting the mounting member to the hook portion of the glazing fitting, wherein there is a shock absorber fixed in the recess portion by an adhesive.

8. The glazing fitting according to claim 7, wherein the hook portion is connectable with the mounting member via the shock absorber.

9. The glazing fitting according to claim 7, wherein the glazing fitting is configured to be securable to the glazing panel via a bore in the glazing panel.

10. The glazing fitting according to claim 7, wherein the shock absorber is compressible.

11. The glazing fitting according to claim 7, wherein the shock absorber is comprised of rubber.

12. The glazing fitting according to claim 7, wherein the shock absorber is irreversibly compressible.

13. The glazing fitting according to claim 7, wherein the shock absorber is selected to have sufficient elasticity to be able to support applied maximum wind loads while still absorbing energy of any anticipated mechanical impact.

* * * * *